US006047643A

United States Patent [19]

Benner et al.

[11] Patent Number: 6,047,643

[45] Date of Patent: Apr. 11, 2000

[54] HERMETICALLY SEALED LASER ACTUATOR/DETONATOR AND METHOD OF MANUFACTURING THE SAME

[75] Inventors: Douglas E. Benner, Springboro; David J. Haas, Trenton; Richard T. Massey, Hamilton; Barry T. Neyer, Cincinnati, all of Ohio

[73] Assignee: EG&G Star City, Inc., Cincinatti, Ohio

[21] Appl. No.: 08/989,544

[22] Filed: Dec. 12, 1997

[51] Int. Cl.[7] ..... F42C 19/00

[52] U.S. Cl. ..... 102/201; 86/1.1

[58] Field of Search ..... 102/201; 385/61, 385/74, 79, 33, 35; 403/29; 359/830; 86/1.1

[56] References Cited

U.S. PATENT DOCUMENTS

| | | | |
|---|---|---|---|
| H1214 | 8/1993 | Liva et al. | 102/201 |
| Re. 34,790 | 11/1994 | Musk | 385/93 |
| 3,284,118 | 11/1966 | Kessler, Jr. | 403/29 |
| 3,362,329 | 1/1968 | Epstein | 102/201 |
| 3,528,372 | 9/1970 | Lewis | 102/201 |
| 3,658,392 | 4/1972 | Platt | 102/201 |
| 3,724,383 | 4/1973 | Gallaghan et al. | 102/201 |
| 4,008,945 | 2/1977 | Schere | 350/1 |
| 4,265,511 | 5/1981 | Nicia et al. | 350/96.18 |
| 4,282,395 | 8/1981 | Hagermann | 174/50.61 |
| 4,343,242 | 8/1982 | Welk | 102/201 |
| 4,451,115 | 5/1984 | Nicia et al. | 350/96.18 |
| 4,753,508 | 6/1988 | Meuleman | 350/96.2 |
| 4,807,958 | 2/1989 | Gunner et al. | 350/96.21 |
| 4,870,903 | 10/1989 | Carel et al. | 102/201 |
| 4,911,523 | 3/1990 | Sondergeld et al. | 350/96.21 |
| 4,917,014 | 4/1990 | Loughry et al. | 102/201 |
| 4,930,418 | 6/1990 | Folsom | 102/201 |
| 5,046,423 | 9/1991 | Paisley | 102/201 |
| 5,104,747 | 4/1992 | Makino et al. | 428/621 |
| 5,138,946 | 8/1992 | Soltz et al. | 102/201 |
| 5,179,246 | 1/1993 | Betts et al. | 102/201 |
| 5,179,247 | 1/1993 | Hawley | 102/201 |
| 5,204,490 | 4/1993 | Soltz et al. | 102/201 |
| 5,206,455 | 4/1993 | Williams et al. | 102/201 |
| 5,247,595 | 9/1993 | Foldi | 385/78 |
| 5,317,973 | 6/1994 | Winaver et al. | 102/201 |
| 5,337,387 | 8/1994 | Kramer | 385/75 |
| 5,404,820 | 4/1995 | Hendrix | 102/201 |
| 5,520,114 | 5/1996 | Guimard et al. | 102/215 |
| 5,573,565 | 11/1996 | Dalton et al. | 65/59.1 |
| 5,664,040 | 9/1997 | Kramer et al. | 385/78 |
| 5,698,083 | 12/1997 | Glass | 204/407 |

FOREIGN PATENT DOCUMENTS

| | | | |
|---|---|---|---|
| 2669724 | 5/1992 | France | 102/201 |
| 1820180 | 6/1993 | U.S.S.R. | 102/201 |

*Primary Examiner*—Harold J. Tudor
*Attorney, Agent, or Firm*—Iandiorio & Teska

[57] ABSTRACT

A hermetically sealed laser actuator/detonator includes a housing with an orifice for receiving a laser beam and a chamber having a first lens, a compression sealing material at least partially about the first lens, and an energetic material optically coupled to the first lens.

31 Claims, 2 Drawing Sheets

HERMETICALLY SEALED LASER ACTUATOR/DETONATOR AND METHOD OF MANUFACTURING THE SAME

FIELD OF INVENTION

This invention relates to a hermetically sealed laser actuator/detonator and method of manufacturing the same.

BACKGROUND OF INVENTION

Laser ignited detonators or actuators are used instead of electrical explosive devices in certain environments where electrical explosive devices are not practical including environments which are subject to appreciable amounts of electromagnetic radiation.

In certain prior art laser detonators, an optical fiber is placed up against or inside an energetic material such as a pyrotechnic material, an explosive material, or a thermite material. When the laser fires, the energetic material burns or detonates thus triggering rocket fuel, or some other explosive such as explosives used in military, mining, or construction operations.

One problem with this design includes the lack of a seal between the optical fiber and the energetic material. Thus, when the energetic material ignites, there is a hole through which fluid and/or gas can escape. Accordingly, these types of devices are unsatisfactory for rocket motors and also for missiles launched out of submarines. Another problem with such detonators is their fragile nature due to the optical fiber extending from the energetic material. Further, such actuators are not re-usable.

Other prior designs include a thin window or a ball lens between the optical fiber and the energetic material. Again, such designs do not provide an adequate seal. A thick window which could withstand the high pressure environment during device function cannot be used because a thick window is not energy efficient, and allows the laser input to diverge failing to achieve the power/energy density required to cause ignition.

SUMMARY OF INVENTION

It is therefore an object of this invention to provide a robust hermetically sealed laser actuator/detonator and method of manufacturing the same.

It is a further object of this invention to provide such a hermetically sealed laser actuator which can withstand the high pressure environment which occurs during functioning and still prevents the leakage of fluid and/or gas.

It is a further object of this invention to provide such a hermetically sealed laser actuator which can be reused.

It is a further object of this invention to provide such a hermetically sealed laser actuator/detonator which is not sensitive to electromagnetic radiation.

It is a further object of this invention to provide such a hermetically sealed laser actuator/detonator which can be adapted for use with a wide variety of fiber optic couplers and bulkhead designs.

It is a further object of this invention to provide such a hermetically sealed laser actuator which maintains a seal even after functioning.

It is a further object of this invention to provide such a hermetically sealed laser actuator/detonator which can be adapted for use with a variety of explosive device types such as flying plates, detonation waves, movement of a piston, gas pressure pulses, or hot flames.

It is a further object of this invention to provide such a hermetically sealed laser actuator/detonator which efficiently couples laser energy into the explosive powder.

This invention results from the realization that a robust hermetically sealed laser detonator can be effected by sealing a ball lens which efficiently focuses laser energy onto the energetic material in a chamber both with a chemical bond and a compression bond, the chemical bond formed by fusing the sealing medium to the interior walls of the chamber, the compression bond formed by choosing the material of the lens, the material of the chamber walls, and the material of the sealing medium such that during manufacture, when the heated sealing medium is urged about the lens and cools, the lens contracts less than the sealing medium and the sealing medium contracts less than the walls of the chamber.

This invention features a hermetically sealed laser actuator/detonator. A housing includes means for receiving a laser beam and a chamber having a first lens, a compression sealing medium at least partially about the first lens, and an energetic material optically coupled to the first lens. The thermal expansion of chamber material is preferably greater than the thermal expansion of the compression sealing medium material which is preferably greater than or equal to the thermal expansion of the lens material thus forming a compression bond about the lens. The chamber material is typically metal such as stainless steel, Iconnel, Hastalloy; the compression sealing medium material is typically glass, ceramic, or glass-ceramic; and the first lens material is preferably sapphire or quartz. The energetic material may be $TiH_x/KClO_4$. The first lens is typically a ball lens and the chamber may further include a Kapton® thermal barrier layer located between the lens and the energetic material.

The means for receiving a laser beam typically includes an orifice in the housing in optical communication with the chamber for receiving an optical fiber. A depending circular chamfered surface separates the orifice from the chamber. The first lens abuts one side of the circular chamfered surface and there may be a second lens in the orifice abutting the other side of the circular chamfered surface. The orifice then further includes a compression sealing medium at least partially about the second lens. Alternatively, a sleeve with a depending circular chamfered surface on a distal end thereof is inserted into the orifice and used to retain the second lens in position. Finally, a flying plate may be placed abutting the energetic material.

This invention also features a hermetically sealed laser actuator/detonator comprising a housing with an orifice for receiving an optical fiber and a chamber optically coupled to the orifice. The chamber includes a first lens, a glass, ceramic, or glass-ceramic sealing medium at least partially about the first lens and the interior of the chamber and an energetic material optically coupled to the first lens. The first lens is a spherical ball lens. The chamber further includes a thermal buffer layer located between the first lens and the energetic material. The housing further includes a depending circular chamfered surface. separating the orifice from the chamber. The first lens abuts the circular chamfered surface on one side and further included may be a second lens in the orifice abutting the other side of the circular chamfered surface. The orifice further includes a compression sealing medium at least partially about the second lens and a flying plate is placed abutting the energetic material.

This invention also features a method of manufacturing a hermetically sealed laser detonator. The method includes selecting the material of a lens, the material of a chamber, and the material of a sealing medium such that the thermal expansion of the chamber material is greater than or equal to the thermal expansion of the compression sealing medium and such that the thermal expansion of the compression sealing medium is greater than or equal to the thermal expansion of the lens material. The lens is placed in a chamber and the heated sealing medium is urged at least partially about the lens and the chamber and then allowed to cool to form a compression bond about the lens. The method further includes placing an energetic material in optical communication with the lens and placing a thermal barrier layer between the energetic material and the lens.

The method of this invention comprises forming a housing to include an orifice for receiving a laser beam and a chamber for housing: a lens, a sealing medium at least partially about the lens, and an energetic material. The lens is placed in the chamber, the sealing medium is urged at least partially about the lens and the interior walls of the chamber, and the energetic material is placed in the chamber in optical communication with the lens. Further included may be the step of placing a thermal barrier material between the lens and the energetic material and constructing a set of depending spaced chamfers within the chamber. The material of the chamber, the material of the sealing medium, and the material of the lens is selected such that the thermal expansion of the chamber material is greater than or equal to the thermal expansion of the sealing medium material which is greater than or equal to the thermal expansion of the lens. For example, the lens may be sapphire or quartz, the chamber may be made of stainless steel, and the sealing medium may be glass, ceramic, or glass-ceramic.

In another embodiment, there is a housing; a first chamber within the housing; a second chamber within the housing; a depending circular chamfered surface. separating the first chamber from the second chamber; a first lens located in the first chamber abutting the circular chaffered surface; and a compression sealing medium at least partially about the first lens within the first chamber.

A sleeve receivable within the second chamber includes a depending circular chamfered surface. on a distal end thereof and a second lens is located in the second chamber between the distal end of the sleeve and the circular chamfered surface. separating the first chamber from the second chamber.

DISCLOSURE OF PREFERRED EMBODIMENT

Other objects, features and advantages will occur to those skilled in the art from the following description of a preferred embodiment and the accompanying drawings, in which.

Figure 1:
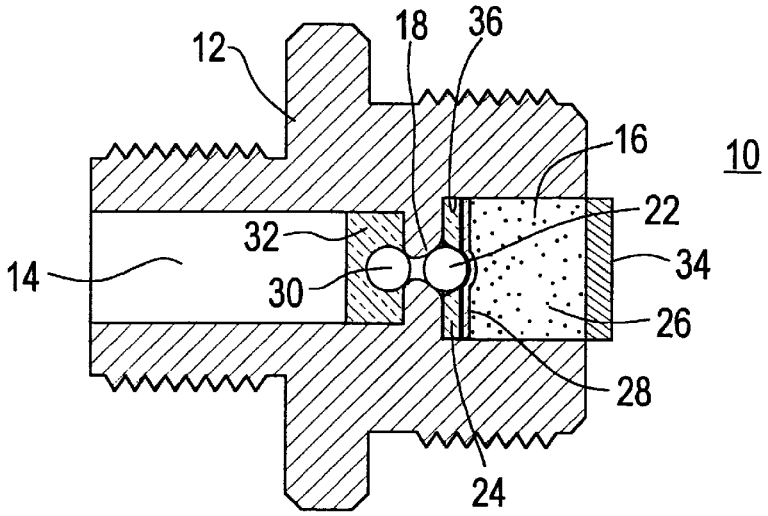
FIG. 1 is a cross-sectional side view of the hermetically sealed laser actuator of this invention.

Hermetically sealed laser detonator/actuator 10, FIG. 1, includes housing 12 having some means for receiving a laser beam, such as orifice 14 and chamber area 16 separated from orifice 14 by depending circular chamfer 18. Chamber 16 includes first ball lens 22 and compression sealing medium 24 partially about ball lens 22 as shown. Chamber 16 also includes energetic material 26 such as a $TiH_x/KClO_4$ explosive charge. Also included in chamber 16 is thermal barrier layer 28, for example, a disk made of Kapton® polyimide which keeps heat from exiting the reaction zone through ball lens 22. Ball lens 22 abuts depending circular chamfer 18 as shown. Also included may be second ball lens 30 in orifice 14 sealed against the opposite side of depending circular chamfer 18 via compression sealing medium 32. In one embodiment, flying plate 34 abuts energetic material 26. Flying plate 34 is preferably made of stainless steel.

Ball lens 22, preferably made of sapphire, provides a hermetic seal between chamber 16 and orifice 14 in combination with compression sealing medium 24 and housing 12 in the following fashion. "S glass" available from Schott is heated to a temperature of about 1000° C. flows about ball lens 22 and forms a chemical bond with the interior wall 36 of housing 12 and also forms a compression bond in that when the S-glass cools, ball lens 22 contracts less than sealing medium 24 and sealing medium 24 contracts less than the interior wall 36 of metallic (e.g. Inconnel, Hastolloy, Stainless Steel) housing 12.

Accordingly, the thermal expansion of chamber 12 is greater than or equal to the thermal expansion of sealing medium 24 which is greater than or equal to the thermal expansion of ball lens 22. The resulting chemical and compression sealing bond prevents fluid or gas from escaping through orifice 14 after energetic material 26 is ignited and also prevents damage to ball lens 22 thus rendering hermetically sealed laser actuator/detonator 10 reusable.

Optional second ball lens 30 may also be sapphire or borosilicate glass and sealing medium 32 about lens 30 within orifice 14 may also be "S-Glass" or an equivalent to similarly provide both a chemical and compression sealing bond in orifice 14 for lens 30. Other possible compression sealing medium materials may include other types of glass or ceramic or glass-ceramic materials. Alternatively, any combination of materials for housing 12, sealing medium 24, and lens 22 may be substituted for the preferred embodiment disclosed above such that a chemical bond is formed between the sealing medium 24 and the interior wall 36 of housing 12 and/or such that a compression bond is formed about ball lens 22 with respect to depending spaced depending circular chamfer 18. Sapphire is the preferred material for ball lens 22 because of its capacity to withstand compression and also its ability to withstand high temperatures. Another material with similar properties is quartz.

The result is a robust hermetically sealed laser actuator/detonator which can withstand the very high pressure environment which occurs during functioning and still prevents the leakage of fluid or gas through orifice 14 in housing 12. Hermetically sealed laser actuator/detonator 10 is not sensitive to electromagnetic radiation. Hermetically sealed laser actuator/detonator 10 is also very efficient in that ball lenses 22 and 30 together efficiently focus the laser pulse from a fiber optic input resulting in a device with a lower firing threshold than a device with a flat window. As such, hermetically sealed laser actuator/detonator 10 efficiently couples laser energy into energetic material 26.

Figure 2:
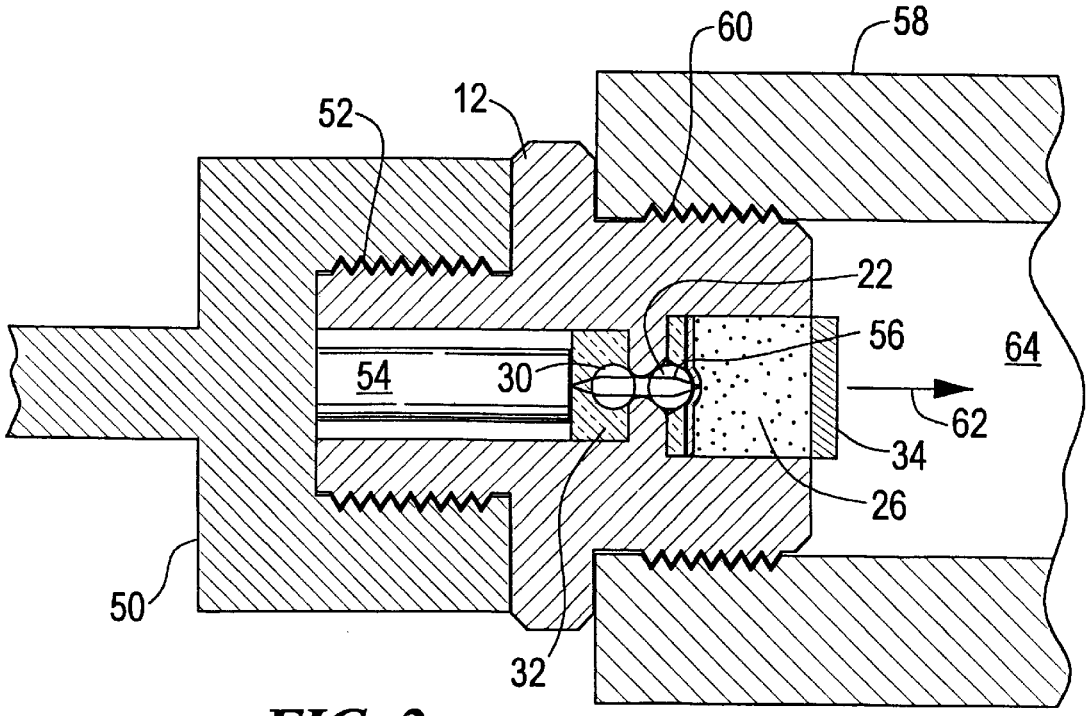
FIG. 2 is a cross-sectional side view of one embodiment of the hermetically sealed laser actuator of this invention shown as an interface between a fiber optic coupler and a bulkhead.

In use, fiber optic coupler 50, FIG. 2, is coupled to housing 12 via threads as shown at 52. Optical fiber 54 is brought to bear upon medium 32 and diverging laser energy, as shown at 56, is focused onto charge 26 via ball lenses 30 and 22. Housing 12 is coupled to bulkhead 58 of a missile, for example, via threads 60. Flying plate 34 travels in the direction shown by arrow 62 to activate, for example, a rocket motor and after functioning, the hermetically sealed laser detonator of this invention prevents gas or liquid from escaping through opening 64 in bulkhead 58. The use of flying plate 34 is not essential to the subject invention because hermetically sealed laser detonator 10 can be used to activate a pressure pulse, a detonation wave, or any other output that can be found in conventional explosive devices.

Figure 3:
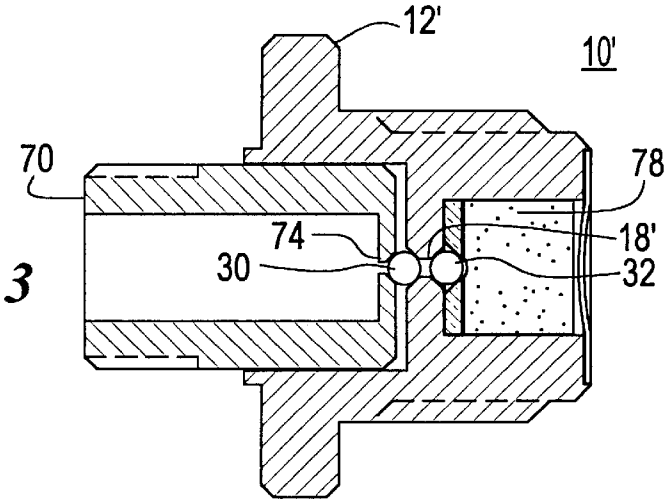
FIG. 3 is a cross-sectional side view of another embodiment of the hermetically sealed laser actuator of this invention.

In an alternate embodiment, sleeve 70, FIG. 3 is used to seal lens 30 about circular chamfer 18', within chamber 14' of housing 12'. Sleeve 70 itself includes depending circular chamfer 74, for this purpose.

Figure 4:
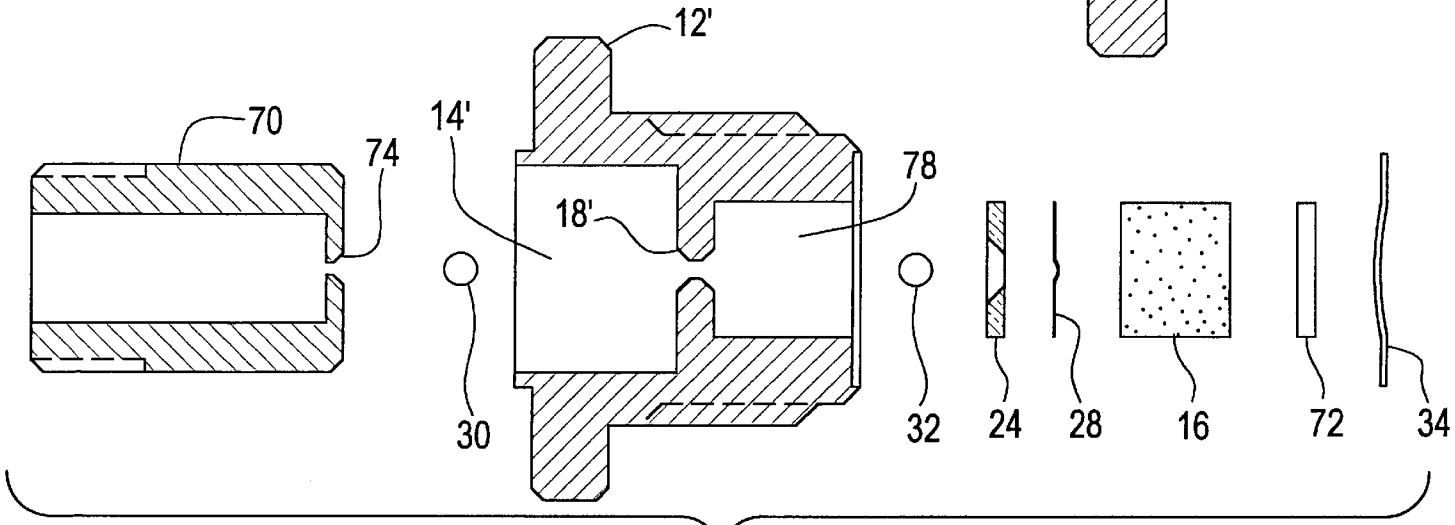
FIG. 4 is an exploded cross-sectional side view of the actuator shown in FIG. 3.

To assemble this embodiment of detonator 10', sapphire or quartz lens 32, FIG. 4, is placed in chamber 78 and glass ring 24 is placed about lens 32. Lens 32 is held in place about circular chamfer 18', with a plunger and shell assembly 12' and is inserted into a furnace where the temperature is elevated to approximately 1000° C. for approximately 5 minutes to melt glass ring 24. The temperature is then lowered to approximately 600° C. for approximately 30 minutes to anneal the glass and form a very strong bond between metallic shell 12' and lens 32. These temperatures and durations are for a housing made of Inconnel, a sapphire lens, and a glass ring made of S-glass. Other temperatures and durations may be used for other materials. The key to a strong bond is adjusting the sealing cycle temperatures and durations such that the thermal expansion of the glass ends up between the thermal expansion of the shell 12' and the sapphire or quartz lens 32.

Second lens 30 is then placed about the other side of circular chamfer 18'. in chamber 14' and sleeve 70 is inserted to hold lens 30 in place. A laser weld bonds sleeve 70 to shell 12'. Next, a visual check and a HeNe laser input check are performed. Thermal barrier material 28 (usually Kapton) is placed into chamber 78 and then explosive powder 16 is pressed on top of the thermal barrier 28. Helium leak testing is performed on the output connector half as well as the finished unit to ensure a hermetic seal has been achieved. Compression pad 72 and disk 34 are then installed.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A hermetically sealed laser actuator/detonator comprising:

a housing including:

means for receiving a laser beam and, a chamber in communication with said means for receiving a laser beam, said chamber containing:

a first spherical lens, a sealing medium at least partially about said first spherical lens forming both a compression bond and a chemical bond between the first spherical lens and the chamber thereby hermetically sealing the first spherical lens in the chamber and in which:

the thermal expansion of the housing is greater than or equal to the thermal expansion of the sealing medium which is greater than or equal to the thermal expansion of the spherical lens, and an energetic material optically coupled to said first spherical lens and adjacent to the sealing medium and said first spherical lens.

2. The hermetically sealed laser actuator/detonator of claim 1 in which the housing is metal, the sealing medium is glass, ceramic, or glass-ceramic, and the first spherical lens is sapphire or quartz.

3. The hermetically sealed laser actuator/detonator of claim 1 in which said chamber further includes a thermal barrier layer located between said first spherical lens and said energetic material.

4. The hermetically sealed laser actuator/detonator of claim 3 in which said thermal barrier layer is a polyimide.

5. The hermetically sealed laser actuator/detonator of claim 1 in which said means for receiving a laser beam includes a second lens.

6. The hermetically sealed laser actuator/detonator of claim 5 in which said second lens is spherical.

7. The hermetically sealed laser actuator/detonator of claim 1 in which said means for receiving a laser beam includes an orifice in said housing in optical communication with said chamber.

8. The hermetically sealed laser actuator/detonator of claim 7 in which said housing includes a depending circular chamfered surface separating said orifice from said chamber.

9. The hermetically sealed laser actuator/detonator of claim 8 in which said first spherical lens abuts the circular chamfered surface on the chamber side thereof.

10. The laser actuator/detonator of claim 8 further including a second lens in said orifice abutting said circular chamfered surface on the orifice side thereof.

11. The laser actuator/detonator of claim 10 in which said orifice further includes a compression sealing medium at least partially about said second lens.

12. The hermetically sealed laser actuator/detonator of claim 1 further including a flying plate abutting said energetic material.

13. The hermetically sealed laser actuator/detonator of claim 7 in which said means for receiving a laser beam further includes a sleeve receivable in said orifice.

14. The hermetically sealed laser actuator/detonator of claim 13 in which said sleeve includes a depending circular chamfered surface on a distal end thereof.

15. A hermetically sealed laser actuator/detonator comprising:

a housing with an orifice for receiving an optical fiber and a chamber optically coupled to said orifice, said chamber containing:

a first spherical lens;

a glass, ceramic, or glass-ceramic sealing medium at least partially about said first spherical lens and the interior of said chamber forming both a compression bond and a chemical bond between the first spherical lens and the chamber thereby hermetically sealing the first spherical lens in the chamber; and an energetic material adjacent the sealing medium and adjacent said first spherical lens, and optically coupled to said first lens.

16. The hermetically sealed laser actuator/detonator of claim 15 in which said chamber further includes a thermal barrier layer located between said first spherical lens and said energetic material.

17. The hermetically sealed laser actuator/detonator of claim 15 in which said housing further includes a depending circular chamfered surface separating said orifice from said chamber.

18. The hermetically sealed laser detonator of claim 17 in which said first spherical lens abuts the circular chamfered surface on one side thereof.

19. The laser actuator/detonator of claim 18 further including a second lens in said orifice abutting said circular chamfered surface on an opposite side thereof.

20. The laser actuator/detonator of claim 19 in which said orifice further includes a compression sealing medium at least partially about said second lens.

21. The hermetically sealed laser actuator/detonator of claim 15 further including a flying plate abutting said energetic material.

22. A hermetically sealed laser actuator/detonator device comprising:

a housing;

a first chamber within said housing;

a second chamber within said housing;

a circular chamfered surface separating said first chamber from said second chamber;

a first spherical lens located in said first chamber abutting said circular chamfered surface on one side thereof;

a sealing medium at least partially about said first spherical lens within said first chamber forming both a compression band and a chemical bond between the first spherical lens and said first chamber thereby hermetically sealing the first spherical lens in said first chamber; and an energetic material disposed in said first chamber adjacent to the sealing medium and said first spherical lens.

23. The device of claim 22 further including a sleeve receivable within said second chamber.

24. The device of claim 23 in which said sleeve includes a depending circular chamfered surface on a distal end thereof.

25. The device of claim 24 further including a second lens located in said second chamber between the distal end of said sleeve and the circular chamfered surface separating the first chamber from the second chamber.

26. A method of manufacturing a hermetically sealed laser actuator/detonator comprising:

selecting the material of a spherical lens, the material of a chamber, and the material of a sealing medium such that the thermal expansion of the chamber material is greater than or equal to the thermal expansion of the sealing medium and such that the thermal expansion of the sealing medium is greater than or equal to the thermal expansion of the lens material;

placing the spherical lens in the chamber;

heating the sealing medium;

urging the heated sealing medium at least partially about the spherical lens and the chamber and allowing it to cool to form both a compression bond and a chemical bond between the spherical lens and the chamber thereby hermetically sealing the spherical lens in the chamber; and placing an energetic material in the chamber, in optical communication with the spherical lens and adjacent the sealing medium and the spherical lens.

27. The method of claim 26 further including placing a thermal barrier layer between the energetic material and the spherical lens.

28. A method of manufacturing a hermetically sealed laser actuator/detonator comprising:

forming a housing to include an orifice for receiving a laser beam and a chamber for housing: a spherical lens, a sealing medium at least partially about the lens, and an energetic material;

placing the lens in the chamber;

urging the sealing medium at least partially about the lens and the interior walls of the chamber; the sealing medium forming both a compression bond and a chemical bond between the spherical lens and the interior walls of the chamber to hermetically seal the spherical lens in the chamber; and placing the energetic material in the chamber in optical communication with the spherical lens and adjacent both the sealing medium and the spherical lens.

29. The method of claim 28 further including the step of placing a thermal barrier material between the spherical lens and the energetic material.

30. The method of claim 28 in which the step of forming further includes constructing a depending circular chamfered surface to separate the orifice from the chamber.

31. The method of claim 28 further including the process of selecting the material of the housing, the material of the sealing medium, and the material of the lens such that the thermal expansion of the housing material is greater than or equal to the thermal expansion of the sealing medium material which is greater than or equal to the thermal expansion of the spherical lens material.

* * * * *